US005134259A

United States Patent [19]

Page, Jr.

[11] Patent Number: 5,134,259

[45] Date of Patent: Jul. 28, 1992

[54] PALM BUTTON SWITCH APPARATUS

[76] Inventor: Lawrence C. Page, Jr., 37816 Winkler, Mount Clemens, Mich. 48045

[21] Appl. No.: 514,163

[22] Filed: Apr. 25, 1990

[51] Int. Cl.[5] ..... H01H 3/12; H01H 13/70

[52] U.S. Cl. ..... 200/341; 200/345; 200/520; 200/304; 336/92; 361/189; 361/181; 83/DIG. 1; 425/DIG. 45; 425/152; 307/115; 192/130

[58] Field of Search ..... 200/600, 293, 341, 345, 200/520, 43.01, 304, 334; 336/92; 361/189, 179, 181, 193; 83/DIG. 1; 425/152, DIG. 45; 250/221; 340/573; 307/114, 115

[56] References Cited

U.S. PATENT DOCUMENTS

| | | | |
|---|---|---|---|
| 3,746,818 | 7/1973 | Bertelloti | 200/168 H |
| 4,074,602 | 2/1978 | Browes | 361/189 |
| 4,519,256 | 5/1985 | Daniels | 73/745 |
| 4,713,509 | 12/1987 | Chebowski | 200/328 |
| 4,760,326 | 7/1988 | Bird | 324/61 P |
| 4,922,197 | 5/1990 | Juds et al. | 324/207.21 |

FOREIGN PATENT DOCUMENTS

| | | | |
|---|---|---|---|
| 608144 | 4/1978 | U.S.S.R. | 192/131 R |

OTHER PUBLICATIONS

"Easy-Touch TM Run Unit" brochure, Compass Industrial Controls (date unknown).

*Primary Examiner*—Henry J. Recla
*Assistant Examiner*—Keith Kupferschmid
*Attorney, Agent, or Firm*—Basile and Hanlon

[57] ABSTRACT

A palm button switch apparatus includes a housing, a solid palm button fixedly mounted on the housing, a guard fixedly mounted on the housing and surrounding the periphery of the palm button. A bore extends through the housing and into the palm button. The bore has an open first end and a second end covered by the palm button. A proximity switch having a sensing end is mounted in the bore with the sensing end disposed in proximity with the palm button for detecting the presence of an operator's fingers on the palm button. The housing, the palm button and the guard are integrally formed as a one-piece unit from a molded plastic.

10 Claims, 2 Drawing Sheets

PALM BUTTON SWITCH APPARATUS

BACKGROUND OF THE INVENTION

Field of the Invention

The present invention relates, in general, to palm buttons and switches.

State of the Art

Palm button operated switches are frequently employed in machine controls to initiate the run or automatic cycle of machines. Typical applications for such palm button operated switches include presses, welders and parts loaders for transfer assembly lines.

For safety purposes, such palm button operated switches are commonly used in pairs to require an operator to depress and hold down each switch with one hand to insure that the operator's hands are clear of the machine when the run cycle begins. Such palm button operated switches are conventionally constructed with a spring-loaded button which mechanically switches contacts within the switch housing between open and closed states when it is depressed.

Since in a typical manufacturing operation, the operator can actuate the run cycle of a machine hundreds of times per hour, the operator must depress and momentarily hold the palm buttons down for a considerable portion of each hour. Although the force required to depress such a spring-loaded palm button is only on the order of a few pounds, the high number of repetitive operations over a short time period have the potential to lead to a cumulative trauma problem, such as Carpal Tunnel Syndrome.

To overcome this problem, and still meet the requirement of having the operator maintain his hands on the palm buttons during the initial start of the run cycle of the machine, it has been proposed to utilize a stationary palm button mounted over a proximity switch which senses the operator's fingers or hand touching the palm button. This arrangement eliminates any mechanical force required to depress the palm button each machine cycle. However, this palm button and switch requires a separate mounting plate and a separate peripheral guard to be attached to or mounted about the push button. This adds to the cost of the push button and increases installation time and part stocking requirements.

Thus, it would be desirable to provide a palm button switch with guard which eliminates any mechanical force required to depress the palm button. It would also be desirable to provide a palm button switch with guard which can be constructed of a minimal number of separate components. It would also be desirable to provide a palm button switch which includes an integral safety guard surrounding the palm button to prevent inadvertent activation of the palm button. Finally, it would be desirable to provide a palm button switch with guard which can be easily manufactured at a low cost.

SUMMARY OF THE INVENTION

The present invention is a palm button switch apparatus for use in manufacturing operations.

In a preferred embodiment, the palm button switch apparatus comprises a palm button and guard unit comprising a housing having a bore extending therethrough. The bore has an open first end and a second end. A palm button is stationarily formed on the housing and overlays and closes the second end of the bore. A peripheral guard is formed on the housing and completely surrounds the periphery of the palm button. The top edge of the peripheral guard is at least even and perferably extends a short distance above the top surface of the palm button. The housing, the palm button and the guard are integrally formed as a one piece unit, preferably from a molded plastic.

The palm button switch apparatus also includes a proximity switch having a sensing end which is mounted in the bore in the housing, with the sensing end disposed in close proximity or registry with the inner surface of the palm button. The proximity switch senses the presence of an operator's fingers or hand on the palm button and generates an output signal indicating the presence of the operator's fingers or hand.

In one embodiment of the present invention, threads are internally formed on the bore in the housing and engage external threads formed on the proximity switch to attach the proximity switch to the housing. The open end of the bore may then be hermetically sealed with a potting compound, such as an epoxy, to close off and seal the proximity switch in the housing. This provides a complete, one-piece, hermetically sealed unit which is impervious to dust, oil, etc.

The palm button switch apparatus of the present invention provides a palm button operator which requires no mechanical force to generate an output signal indicating that an operator's fingers or hand are touching the palm button. This prevents any possibility of a cumulative trauma problem resulting from the repetitive depression of conventional spring-operated palm buttons. Further, the palm button switch apparatus of the present invention is uniquely constructed as a one-piece, integral, sealed unit in which the housing, the palm button and the palm button guard are integrally formed as a single, one-piece unit from a molded or machined plastic. Besides minimizing the number of separate components required for the palm button switch apparatus, the palm button switch apparatus of the present invention provides a hermetically sealed unit without the use of separate gaskets or seal members. Further, the palm button switch apparatus of the present invention may be used as a direct replacement for conventional spring-operated palm buttons without any changes in mounting requirements, etc. Finally, the one-piece assembly of the palm button switch apparatus of the present invention simplifies both installation of the switch as well as minimizing part stocking requirements.

BRIEF DESCRIPTION OF THE DRAWING

The various features, advantages and other uses of the present invention will become more apparent by referring to the following detained description and drawing in which.

DESCRIPTION OF THE PREFERRED EMBODIMENTS

Figure 1:
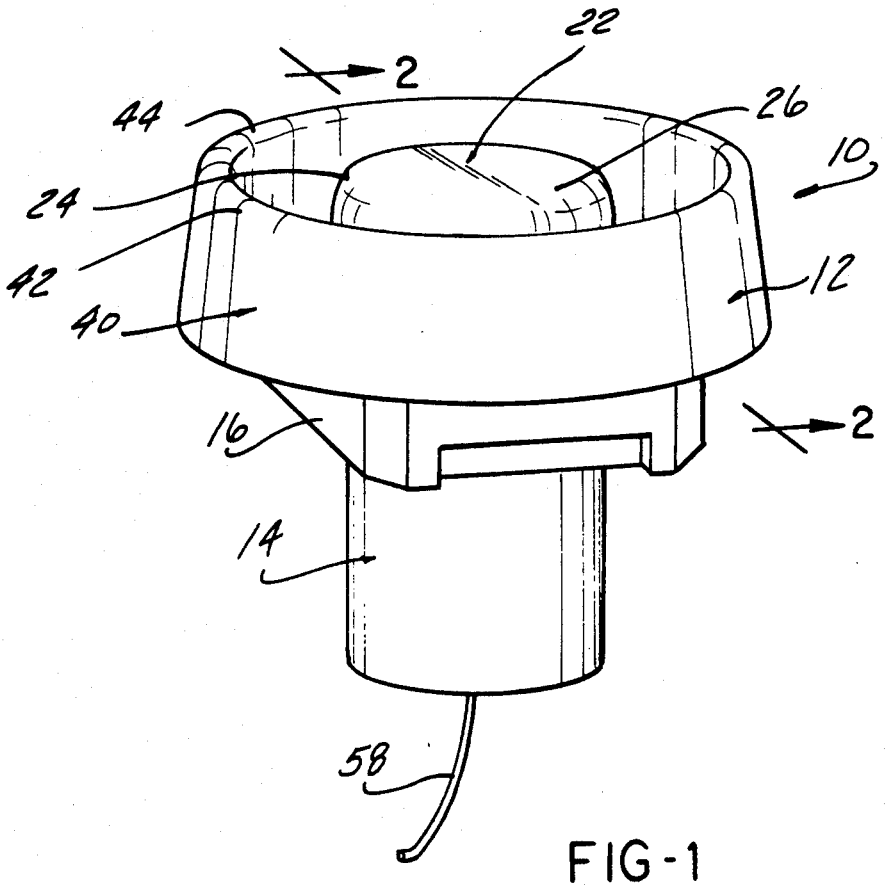
FIG. 1 in a perspective view of the palm button switch apparatus of the present invention.

Throughout the following description and drawing, an identical reference number is used to refer to the same component shown in multiple figures of the drawing.

Referring now to the drawing, and in general to FIG. 1, there is illustrated a palm button switch apparatus 10 comprising a palm switch button and guard 12 and a proximity switch constructed in accordance with the teachings of the present invention. The palm button switch apparatus 10 is designed to generate an output signal when an operator places his fingers or hand on the palm button. However, no mechanical force is required to active the palm button switch apparatus 10 of the present invention.

Figure 2:
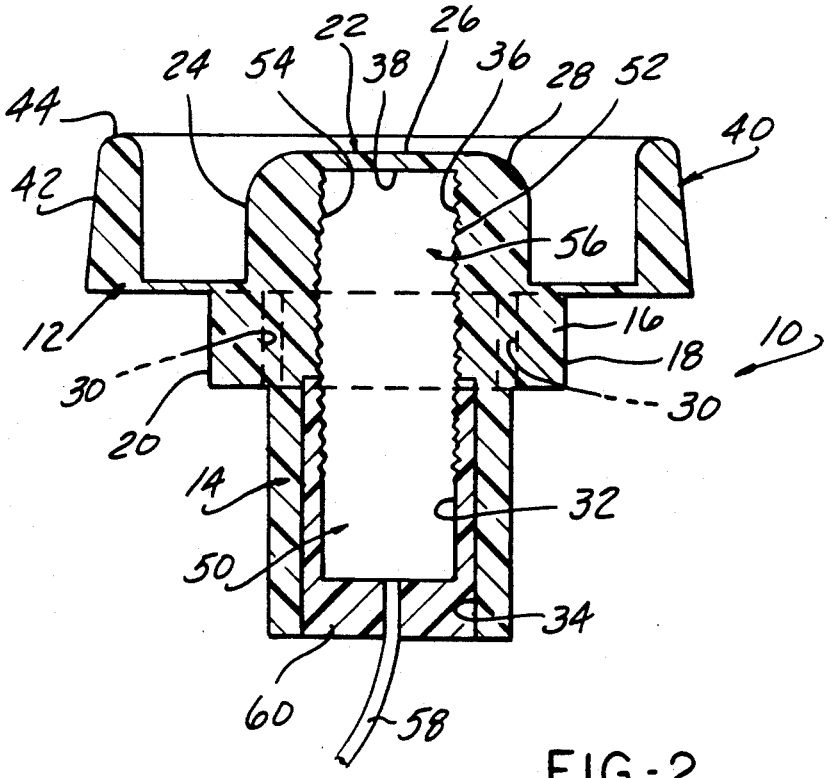
FIG. 2, is a partially cross-sectioned view generally taken along line 2—2 in FIG. 1.
Figure 3:
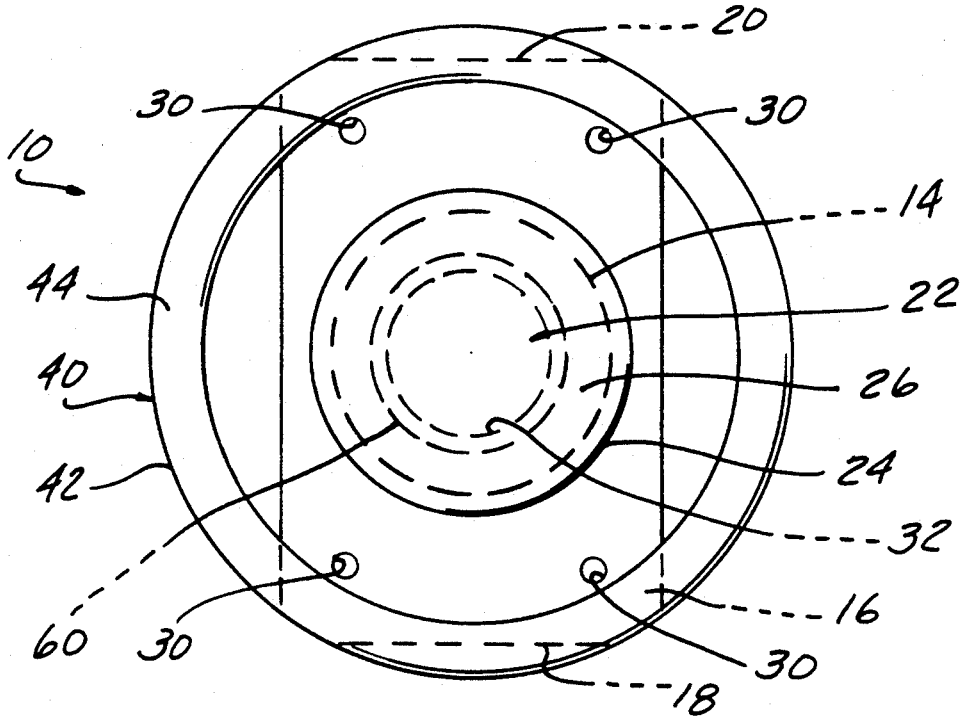
FIG. 3 is a plan view of the palm button switch apparatus shown in FIG. 1.

As shown in detail in FIGS. 1 and 2, the palm button and guard 12 includes a housing 14. By way of example only, the housing 14 has a cylindrical tubular shape. A mounting flange 16 having a substantially rectangular form is mounted adjacent to and contiguous with one end of the housing 14 and forms an integral part therewith. The mounting flange 16 has opposed ends 18 and 20 which extend outward beyond the peripheral side walls of the housing 14.

A palm button 22 is integrally mounted on the mounting flange 16 and extends outward therefrom. The palm button 22 may have any shape, such as a generally hemispherical shape or the shape shown in FIG. 2 which includes generally straight side walls 24, a flat, exposed top surface 26 and rounded corners 28 between the top surface 26 and the side walls 24.

A plurality of small diameter through bores 30 formed in a predetermined mounting arrangement are formed in and extend through the mounting flange 16. The through bores 30 provide mounting locations for fasteners, not shown, for securing the palm button switch apparatus 10 to a operator station, machine, etc.

A bore 32 is provided with an open first end 34 adjacent the exterior end of the housing 14 and a second end 36. The second end 36 of the bore 32 is disposed adjacent to the inner surface 38 of the top surface 26 of the palm button 22. As shown in FIG. 2, the bore 32 extends through the housing 14 and the mounting flange 16 and into the interior of the palm button 22.

The palm button switch apparatus 10 of the present invention also includes a guard denoted in general by reference number 40 which surrounds the periphery of the palm button 22 to protect the palm button 22 from inadvertent contact with external objects. The guard 40 is preferably in the form of an annular flange having a tapered side wall 42 which is integrally formed with the palm button 22 and the mounting flange 16, as shown in FIG. 2. The side walls of the guard 40 are radially spaced from the side walls 24 of the palm button 22.

The upper peripheral edge 44 of the guard 40 is at least even or flush with the top surface 26 of the palm button 22. Preferably, however, the upper peripheral edge 44 of the guard 40 extends upward a small distance above the top surface 26 of the palm button 22 to completely surround and encompass the palm button 22.

The housing 14, the mounting flange 16, the palm button 22 and the guard 40 are preferably formed as an integrally constructed, one-piece unit. Preferably, a plastic material is used to form the complete apparatus 10 which can be molded or machined from a suitable plastic, such as nylon. Other plastic materials may also be employed in addition to that described above. In this manner, the bore 32 may be easily hermetically sealed without the need for additional seals or gaskets as with previously devised palm button assemblies.

The palm button switch apparatus 10 also includes a non-movable, sensor means which detects the presence of an operator's fingers or hand on the upper surface 26 of the palm button 22. In a preferred embodiment, the sensor means 50 comprises a proximity switch, such as an inductive or capacitive switch sold by Efector of Exton, PA, 8036A Series. As shown in FIG. 2, the proximity switch, which in a preferred embodiment is a capacitive switch, has a generally cylindrical, tubular shape with a diameter that enables it to be disposed within the bore 32 in the housing.

Means are provided for fixingly mounting the proximity switch 30 in the bore 32. In a preferred embodiment, a plurality of threads 52 are formed on the side walls of the bore 32 and extend a predetermined distance from the second end 36 of the bore 32. The threads 52 threadingly engage threads 54 formed on the side walls of the proximity switch 50 so as to enable the proximity switch 50 to be threadingly inserted into the bore 32 for mounting in the palm button switch apparatus 10.

When the proximity switch 50 is threadingly inserted fully into the bore 32, the sensing end 56 of the palm switch 50 is disposed in close proximity with and preferably in contact with the inner surface 38 of the top surface 26 of the palm button 22. As is well known, such proximity switches detect the presence of an object within a specified detection range. This range may be adjusted by an adjustment screw, not shown, which is mounted on the proximity switch 50. Thus, when the proximity switch 50 is fully inserted into the bore 32, the sensing end 56 of the proximity switch 50 will be disposed in close proximity with the top surface 26 of the palm button 22 thereby detecting and generating an output signal on conductors 58 when an operator's fingers or hand is placed in contact with the upper surface 26 of the palm button 22. The conductors 58 may be connected to any suitable machine control circuitry which employs the palm button switch apparatus 10 to initiate the run cycle of a machine.

Finally, as shown in FIG. 2, a suitable potting compound 60, such as an epoxy, may be inserted through the open end 34 of the bore 32 after the proximity switch 50 has been inserted into the bore 32 to sealingly close off the bore 32 and hermetically seal the proximity switch 50 in the palm switch apparatus.

Figure 4:
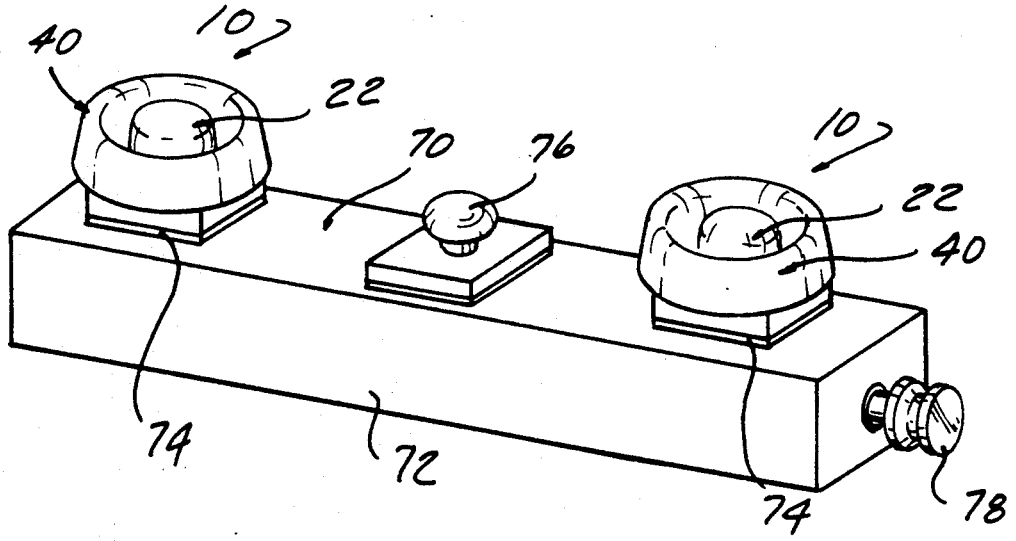
FIG. 4 is a perspective view showing a typical application of the palm button switch apparatus of the present invention.

Referring now to FIG. 4, there is depicted a typical application of the palm button switch apparatus 10 of the present invention. In this application, a pair of palm button switch apparatus 10 are mounted on an operator run station 70. The operator run station 70 is preferably in the form of an elongated, hollow, sealed enclosure which contains suitable mounting apertures on one surface for receiving the palm button switch apparatus 10. Fasteners are disposed through the mounting bores 30 in each palm button switch apparatus 10 to fixedly mount each apparatus 10 to the enclosure 72. Conventional gaskets 74 are mounted between the mounting flange 16 of each palm button switch apparatus 10 and the enclosure 30 to seal the apertures in the enclosure 30. Also, a conventional, mushroom-shaped stop button 76 is centrally mounted on the operator station 70. The conductors 58 from each of the palm switch apparatus 10, as well as the conductors from the stop button 76, exit the enclosure 72 through a suitable fitting or connector 78.

In summary, there has been disclosed a unique palm button switch apparatus which contains an integral palm button and guard. In the apparatus, the palm button is stationarily mounted in registry with a proximity switch such that no mechanical force is needed to activate or detect the presence of an operator's hand or fingers on the palm button. The palm button switch apparatus is constructed as an integral one-piece unit from a molded or machined plastic so as to be used as a direct replacement for conventional spring-loaded palm buttons. Further, the one piece construction minimizes part storage requirements, simplifies installation and provides a complete hermetically sealed unit without additional seals or gaskets.

What is claimed is:

1. A palm button switch apparatus comprising:

a housing;

a palm button formed on the housing;

a guard formed on the housing and completely surrounding the periphery of the palm button, with the palm button being accessible interiorly of the guard, the top edge of the guard being at least even with the top surface of the palm button;

a bore extending through the housing, the bore having an open first end at one end of the housing and a second end disposed adjacent to the palm button, the palm button closing the second end of the bore;

the housing, the palm button and the guard being integrally formed as a one-piece unit; and a proximity switch having a sensing end mounted in the bore for detecting the presence of an operator's fingers on the palm button, the sensing end of the proximity switch being disposed in close proximity with the palm button.

2. The apparatus of claim 1 wherein the guard is annular.

3. The apparatus of claim 1 wherein the top edge of the guard extends above the top surface of the palm button.

4. The apparatus of claim 1 wherein the housing, the palm button and the guard are integrally formed as a one-piece unit from a molded plastic.

5. The apparatus of claim 1 further including:

a plurality of internal threads formed on the bore in the housing and extending a predetermined distance from the second end of the bore; and external threads formed on the proximity switch and engaging the internal threads in the bore for mounting the proximity switch in the bore.

6. A palm button and guard apparatus for use with a proximity switch having a sensing end, the apparatus comprising:

a housing;

a solid palm button formed on the housing;

a peripheral guard formed on the housing and spaced from and surrounding the palm button, with the palm button being accessible interiorly of the guard;

a bore extending through the housing, the bore having a first open end at one end of the housing and a second end adjacent to and covered by the palm button; and the housing, the palm button and the guard being integrally formed as a one-piece unit.

7. The apparatus of claim 6 wherein the housing, the palm button and the guard are integrally formed as a one-piece unit from a molded plastic.

8. The apparatus of claim 6 further including:

a plurality of internal threads formed in the bore and extending a predetermined distance from the second end of the bore, the threads threadingly engaging external threads formed on the proximity switch for mounting the proximity switch in the bore.

9. The apparatus of claim 6 wherein the guard has an annular side wall surrounding and spaced from the palm button.

10. The apparatus of claim 9 wherein the top edge of the guard is at least even with the top surface of the palm button.

* * * * *